US006117001A

United States Patent [19]

Enomoto et al.

[11] Patent Number: 6,117,001

[45] Date of Patent: Sep. 12, 2000

[54] ELECTROLYTIC IN-PROCESS DRESSING METHOD, ELECTROLYTIC IN-PROCESS DRESSING APPARATUS AND GRINDSTONE

[75] Inventors: Toshiyuki Enomoto, Tokyo; Hiroyuki Endo; Yutaka Shimazaki, both of Kanagawa-ken; Yasuhiro Tani, Tokyo; Yoshiyuki Sato, Kanagawa-ken, all of Japan

[73] Assignee: Ricoh Company, Ltd., Tokyo, Japan

[21] Appl. No.: 09/156,705

[22] Filed: Sep. 18, 1998

Related U.S. Application Data

[62] Division of application No. 08/693,757, Aug. 7, 1996, Pat. No. 5,868,607.

[30] Foreign Application Priority Data

Aug. 7, 1995 [JP] Japan ..... 7-200155
Mar. 22, 1996 [JP] Japan ..... 8-093543

[51] Int. Cl.[7] ..... B24D 11/00

[52] U.S. Cl. ..... 451/541; 451/443; 451/544; 51/295

[58] Field of Search ..... 451/443, 541, 451/544, 546, 547; 51/295, 293, 298

[56] References Cited

U.S. PATENT DOCUMENTS 4,167,081 9/1979 Marmo .
4,343,651 8/1982 Yazu et al. .
4,514,483 4/1985 Matsuura et al. ..... 451/28
4,930,486 6/1990 Kuromatsu .
5,119,595 6/1992 Ushiyama et al. .
5,125,933 6/1992 St. Pierre ..... 51/295
5,547,414 8/1996 Ohmori .
5,645,476 7/1997 Meyer ..... 451/544

FOREIGN PATENT DOCUMENTS 6-254754 9/1994 Japan .

*Primary Examiner*—Eileen P. Morgan
*Attorney, Agent, or Firm*—Dickstein Shapiro Morin & Oshinsky LLP

[57] ABSTRACT

An electrolytic in-process dressing method, an electrolytic in-process dressing grinding apparatus, and an electrolytic in-process dressing grindstone, for grinding workpiece as the grindstone is being subjected to electrolytic in-process dressing, are provided, in which the grindstone is made of abrasive grains and a binding material which is capable of forming a uniform and fine passive layer at the grinding surface thereof and also capable of preventing excessive elusion of the binding material, thereby preventing the formation of chips at the ground surface in the course of grinding operation.

2 Claims, 16 Drawing Sheets

ELECTROLYTIC IN-PROCESS DRESSING METHOD, ELECTROLYTIC IN-PROCESS DRESSING APPARATUS AND GRINDSTONE

This is a divisional of U.S. patent application Ser. No. 08/693,757, filed Aug. 7, 1996, now U.S. Pat. No. 5,868, 607.

BACKGROUND OF THE INVENTION

1. Field of the Invention

The present invention relates to an electrolytic in-process dressing method, an electrolytic in-process dressing grinding apparatus, and an electrolytic in-process dressing grindstone, for grinding workpiece as the grindstone is being subjected to electrolytic in-process dressing.

2. Discussion of Background

Recently metal bonded grindstones comprising abrasive grains with high degree of hardness have been developed as being useful for grinding hard and tough materials such as ceramics with high efficiency and as a matter of fact, the advantageous effects thereof have been appreciated.

Such grindstones, however, have the shortcomings that the tooling performance and dressing performance thereof are poor, and in-process dressing is difficult, so that stable machining is difficult to perform by use of such grindstones in conventional grinding techniques.

As a method of solving such conventional problems, electrolytic in-process dressing grinding (hereinafter referred to as "ELID-grinding"), which is capable of promoting in-process dressing in the course of grinding, has been developed and is recently attracting attention.

An example of such an ELID-grinding method is disclosed, for example, in Japanese Laid-Open Patent Application 6-254754.

In the ELID-grinding method, there is employed a grindstone comprising a binding material composed of an iron-based metal as the main component and other metallic additives, or a binding material composed of at least two components selected from the group consisting of cast iron, cobalt, nickel and copper. In this method, the above binding material is used as a positive electrode, and a negative electrode is disposed with a predetermined distance from a contact surface of the grindstone, with an electroconductive fluid with low conductivity being placed between the positive electrode and the negative electrode in contact therewith, a voltage is applied across the positive electrode and the negative electrode, so that the binding material is electrolytically eluted.

More specifically, as illustrated in FIG. 14, when the above-mentioned binding material which serves as the matrix material for supporting abrasive grains (hereinafter referred to as grains) comes into contact with the above-mentioned electroconductive fluid which is, for instance, an aqueous liquid serving as grinding fluid, iron ions are eluted from the binding material, so that in the electrolytic predressing, grains 1 begin to protrude from the surface of the grindstone due to the elusion of the iron ions as illustrated in (A) in FIG. 14, and at the same time, the eluted iron ion is bonded to hydroxyl ion to form iron hydroxide or iron oxide, and the thus formed iron hydroxide or iron oxide accumulates on the surface of the grindstone, whereby a passive layer is formed as illustrated in (B) in FIG. 14.

When the thickness of the passive layer increases to a certain thickness, the electric resistivity of the grindstone increases and the current which flows the binding material decreases, so that the elusion of the iron ions from the binder material is hindered. Thus, the protrudent grains 1 can grind a workpiece (not shown) as illustrated in (C) in FIG. 14. When the protrudent grains 1 wear down in the course of the grinding of the workpiece to the same level as that of the passive layer, the passive layer is worn down or removed in contact with the workpiece as illustrated in (D) in FIG. 14.

When the thickness of the passive layer decreases to a certain thickness, the resistivity of the grindstone increases and the elusion of iron ions from the binding material begins, so that the redressing of the grindstone is carried out with the recovery of the previously mentioned passive layer as shown in (B) in FIG. 14, whereby the so-called ELID cycle is repeated. Thus, the protrusion of the grains remains constant in general use, and stable grinding can be performed constantly for an extended period of time.

Thus, in a grindstone comprising a binding material composed of an iron-based metal as the main component and other metallic additives, or in a grindstone comprising a binding material composed of at least two components selected from the group consisting of cast iron, cobalt, nickel and copper, the dressing of the grindstone can be performed during grinding operation, that is, electrolytic in-process dressing can be performed during grinding operation. Therefore, it is unnecessary to stop grinding operation from time to time during grinding operation due to the loading of the grindstone.

Furthermore, as mentioned previously, a conventional grindstone for use in ELID-grinding method comprises a binding material composed of an iron-based metal as the main component and other metallic additives, or a binding material composed of at least two components selected from the group consisting of cast iron, cobalt, nickel and copper, so that the grindstone is highly wear resistant to workpieces to be ground. Furthermore, a passive layer can be easily formed and the dressing of the grindstone can be performed by electrolytic in-process dressing.

However, the above-mentioned conventional grindstone has the problem that the ground surface obtained by the grindstone is rougher than those obtained by grindstones comprising other binding materials, for instance, a vitrified grinding wheel. In particular, when obtaining a mirror surface in a hard and brittle material, scratches and cracks are apt to be formed by the above-mentioned conventional grindstone, so that the quality of the ground product is lowered.

Furthermore, when any of the above-mentioned conventional grindstones is employed in ELID-grinding method, a period of at least 10 minutes is required to perform predressing, so that the grinding time and efficiency are not always good.

SUMMARY OF THE INVENTION

It is therefore a first object of the present invention to provide an electrolytic in-process dressing method for performing high mirror-surface-quality grinding, with realization of the reduction of the predressing time and grinding time, and significant improvement of grinding efficiency.

A second object of the present invention is to provide an electrolytic in-process dressing grinding apparatus capable of performing the above-mentioned electrolytic in-process dressing method.

A third object of the present invention is to provide an electrolytic in-process dressing grindstone which is capable of forming a uniform and fine passive layer at the grinding contact surface thereof during the electrolytic in-process dressing grinding operation, with the prevention of the formation of chips made from grains detached from the binding material due to excessive elusion thereof during the grinding operation, and therefore which is capable of performing grinding with high quality and high precision.

A fourth object of the present invention is to provide another electrolytic in-process dressing grinding method capable of performing grinding with high quality and high precision by using the above-mentioned grindstone.

A fifth object of the present invention is to provide another electrolytic in-process dressing apparatus capable of performing grinding with high quality and high precision by using the above-mentioned grindstone.

The first object of the present invention can be achieved by an electrolytic in-process dressing grinding method for grinding a workpiece, comprising the steps of:

applying a voltage across (a) an electroconductive grindstone comprising a surface layer which comprises abrasive grains and a binding material in which said abrasive grains are uniformly distributed and supported by said binding material, the surface layer comprising a barrier layer and a uniform porous layer which is provided on said barrier layer, and being capable of becoming a passive layer composed of the binding material under the application of the voltage thereto, and capable of coming into contact with a workpiece, and (b) an electrode which is disposed so as to face the surface layer of the electroconductive grindstone with a predetermined distance therefrom, serving as a counter electrode for the electroconductive grindstone, with an electroconductive fluid being supplied between the surface layer of the electroconductive grindstone and the electrode in such a manner that an electrolytic reaction can be caused to take place between the surface layer of the electroconductive grindstone and the electrode under the application of the voltage; and grinding the workpiece with the electroconductive grindstone, while dressing the surface layer of the electroconductive grindstone by the electrolytic reaction during the course of the grinding of the workpiece.

The second object of the present invention can be achieved by an electrolytic in-process dressing grinding apparatus for grinding a workpiece, comprising:

an electroconductive grindstone comprising a surface layer which comprises abrasive grains and a binding material in which the abrasive grains are uniformly distributed and supported by the binding material, the surface layer comprising a barrier layer and a uniform porous layer which is provided on the barrier layer, and being capable of becoming a passive layer composed of the binding material under the application of a voltage thereto, and capable of coming into contact with a workpiece;

an electrode which is disposed so as to face the surface layer of the electroconductive grindstone with a predetermined distance therefrom, serving as a counter electrode for the electroconductive grindstone;

electroconductive fluid supplying means for supplying an electroconductive fluid between the surface layer of the electroconductive grindstone and the electrode for causing an electrolytic reaction to take place between the surface layer of the electroconductive grindstone and the electrode; and voltage application means for applying the voltage across the electroconductive grindstone and the electrode to cause the electrolytic reaction to take place between the surface layer of the electroconductive grindstone and the electrode, thereby grinding the workpiece with the electroconductive grindstone, while dressing the surface layer of the electroconductive grindstone by the electrolytic reaction during the course of the grinding of the workpiece.

The third object of the present invention can be achieved by an electrolytic in-process dressing grindstone for grinding a workpiece, comprising a surface layer which comprises abrasive grains and a binding material consisting of a single metal component, in which the abrasive grains are uniformly distributed and supported by the binding material, and can be subjected to dressing in the course of the grinding of the workpiece, or by an electrolytic in-process dressing grindstone for grinding a workpiece, comprising a surface layer which comprises abrasive grains and a binding material consisting of a single metal component and a material with a resistivity of 1 MΩ.cm or more, in which the abrasive grains are uniformly distributed and supported by the binding material, and can be subjected to dressing in the course of the grinding of the workpiece.

The fourth object of the present invention can be achieved by an electrolytic in-process dressing grinding method for grinding a workpiece, comprising the steps of:

applying a voltage across (a) an electroconductive grindstone comprising a surface layer which comprises abrasive grains and a binding material consisting of a single metal component, or a binding material consisting of a single metal component and a material with a resistivity of 1 MΩ.cm or more, in which the abrasive grains are uniformly distributed and supported by the binding material, and can be subjected to dressing in the course of the grinding of the workpiece, and being capable of becoming a passive layer composed of the binding material under the application of the voltage thereto, and capable of coming into contact with a workpiece, and (b) an electrode which is disposed so as to face the surface layer of the electroconductive grindstone with a predetermined distance therefrom, serving as a counter electrode for the electroconductive grindstone, with an electroconductive fluid being supplied between the surface layer of the electroconductive grindstone and the electrode in such a manner that an electrolytic reaction can be caused to take place between the surface layer of the electroconductive grindstone and the electrode under the application of the voltage; and grinding the workpiece with the electroconductive grindstone, while dressing the surface layer of the electroconductive grindstone by the electrolytic reaction during the course of the grinding of the workpiece.

The fifth object of the present invention can be achieved by an electrolytic in-process dressing grinding apparatus for grinding a workpiece, comprising:

an electroconductive grindstone comprising a surface layer which comprises abrasive grains and a binding material consisting of a single metal component, or a binding material consisting of a single metal component and a material with a resistivity of 1 MΩ.cm or more, in which the abrasive grains are uniformly distributed and supported by the binding material, and can be subjected to dressing in the course of the grinding of the workpiece, and being capable of becoming a passive layer composed of the binding material under the application of the voltage thereto, and capable of coming into contact with a workpiece;

an electrode which is disposed so as to face the surface layer of the electroconductive grindstone with a predetermined distance therefrom, serving as a counter electrode for the electroconductive grindstone, with an electroconductive fluid being supplied between the surface layer of the electroconductive grindstone and the electrode in such a manner that an electrolytic reaction can be caused to take place between the surface layer of the electroconductive grindstone and the electrode under the application of the voltage;

electroconductive fluid supplying means for supplying an electroconductive fluid between the surface layer of the electroconductive grindstone and the electrode for causing an electrolytic reaction to take place between the surface layer of the electroconductive grindstone and the electrode; and voltage application means for applying the voltage across the electroconductive grindstone and the electrode to cause the electrolytic reaction to take place between the surface layer of the electroconductive grindstone and the electrode, thereby grinding the workpiece with the electroconductive grindstone, while dressing the surface layer of the electroconductive grindstone by the electrolytic reaction during the course of the grinding of the workpiece.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 3(*b*) is a diagram showing the surface roughness of a workpiece ground by a conventional electrolytic in-process dressing grinding apparatus.

FIG. 6(*b*) is an enlarged scale with a total length of 1 mm for use with FIG. 6(*a*).

FIG. 7(*b*) is a cross-sectional view B (which is different from the cross-sectional view A) of the contact surface of the same comparative grinding wheel as in FIG. 7(*a*) after being subjected to the electrolytic in-process dressing.

FIG. 8(*b*) shows a groove formed in a workpiece made of glass by use of another conventional grinding wheel which comprises a binding material consisting of aluminum and copper by electrolytic in-process dressing cutting.

FIG. 9(*b*) is the same enlarged scale with a total length of 1 mm as shown in FIG. 6(*b*), for use with FIG. 9(*a*).

FIG. 10(*b*) shows a cross section formed in the workpiece made of glass by another conventional grinding wheel which comprises a binding material consisting of aluminum and copper by electrolytic in-process dressing cutting.

FIG. 11(*b*) is the same enlarged scale with a total length of 1 mm as shown in FIG. 6(*b*), for use with FIG. 11(*a*).

FIG. 12(*b*) shows a groove formed by use of an electroconductive fluid with a chlorine ion concentration of 20 ppm.

FIG. 12(*c*) shows a groove formed by use of an electroconductive fluid with a chlorine ion concentration of 10 ppm.

FIG. 12(*d*) shows a groove formed by use of an electroconductive fluid with a chlorine ion concentration of 0 ppm.

FIG. 13(*b*) shows a cross section formed by use of an electroconductive fluid with a chlorine ion concentration of 20 ppm.

FIG. 13(*c*) shows a cross section formed by use of an electroconductive fluid with a chlorine ion concentration of 10 ppm.

FIG. 13(*d*) shows a cross section formed by use of an electroconductive fluid with a chlorine ion concentration of 0 ppm.

DESCRIPTION OF THE PREFERRED EMBODIMENTS

Figure 1:
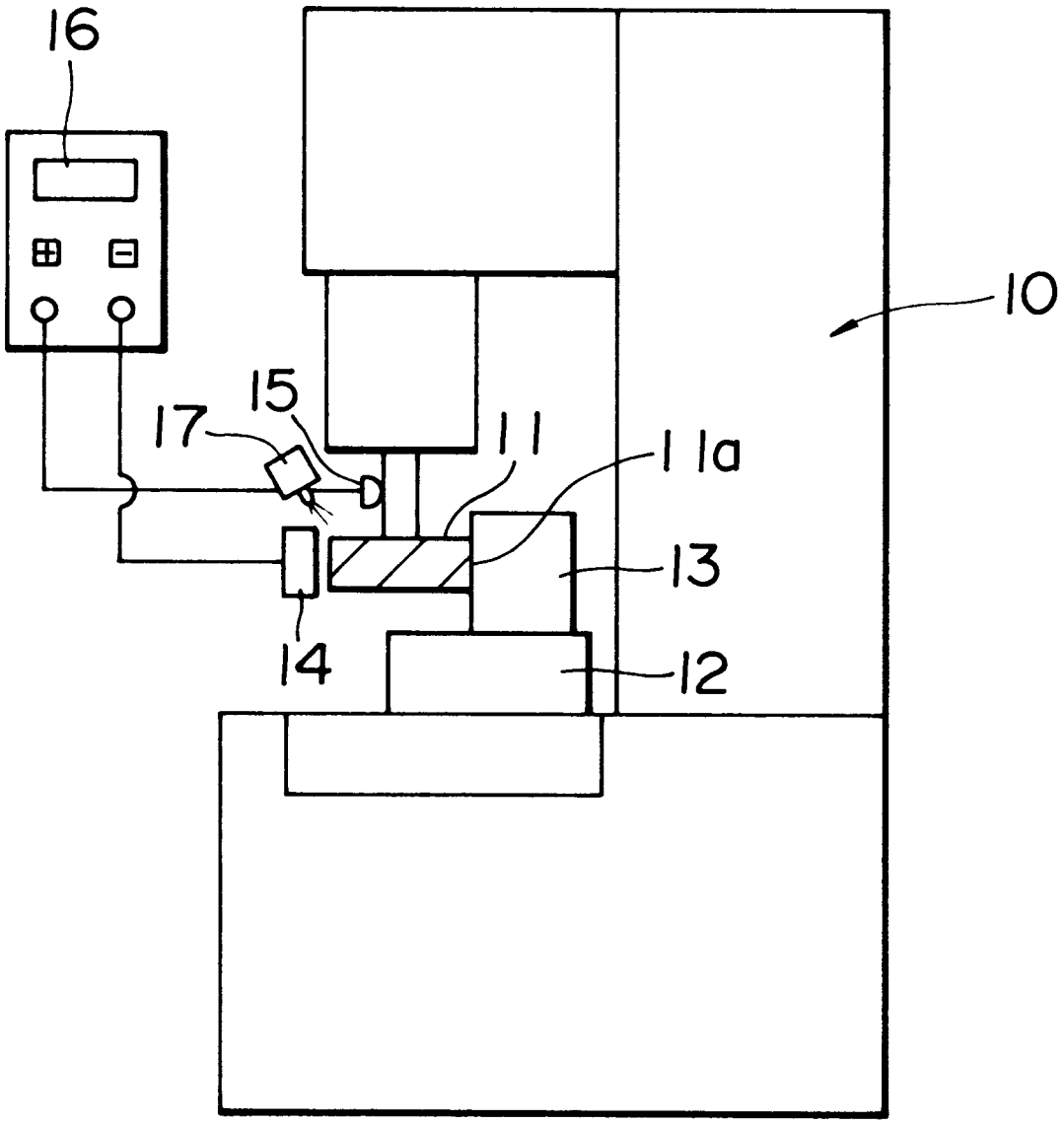
FIG. 1 is a schematic cross-sectional view of an example of an electrolytic in-process dressing grinding apparatus of the present invention.

An electrolytic in-process dressing grinding method of the present invention comprises the steps of:

applying a voltage across (a) an electroconductive grindstone comprising a surface layer which comprises abrasive grains and a binding material in which the abrasive grains are uniformly distributed and supported by the binding material, the surface layer comprising a barrier layer and a uniform porous layer which is provided on the barrier layer, and being capable of becoming a passive layer composed of the binding material under the application of the voltage thereto, and capable of coming into contact with a workpiece, and (b) an electrode which is disposed so as to face the surface layer of the electroconductive grindstone with a predetermined distance therefrom, serving as a counter electrode for the electroconductive grindstone, with an electroconductive fluid being supplied between the surface layer of the electroconductive grindstone and the electrode in such a manner that an electrolytic reaction can be caused to take place between the surface layer of the electroconductive grindstone and the electrode under the application of the voltage; and grinding the workpiece with the electroconductive grindstone, while dressing the surface layer of the electroconductive grindstone by the electrolytic reaction during the course of the grinding of the workpiece.

In the electrolytic in-process dressing grinding method of the present invention, a passive layer is formed in the shape of a uniform and fine porous layer via a barrier in the surface layer of the electroconductive grindstone, so that the supporting force for the abrasive grains (hereinafter referred to as the grains) imparted thereto by the binding material and also by the passive layer is uniform in the surface layer in its entirety, and therefore, the protrusion of the grains is uniform in the entire surface of the grindstone. As a result, few scratches and cracks are formed in the surface of the grindstone, and therefore a ground surface with excellent mirror-surface-quality roughness and high precision can be obtained by this grindstone.

Furthermore, the porosity of the porous layer formed on the barrier layer is uniform and fine, and the passive layer can be quickly formed in the surface layer and therefore, the predressing time can be significantly reduced and the grinding time can also be significantly reduced, with remarkable improvement of the grinding efficiency.

The above-mentioned performance can be furthermore improved when the binding material consists essentially of aluminum.

An electrolytic in-process dressing grinding apparatus of the present invention comprises:

an electroconductive grindstone comprising a surface layer which comprises abrasive grains and a binding material in which the abrasive grains are uniformly distributed and supported by the binding material, the surface layer comprising a barrier layer and a uniform porous layer which is provided on the barrier layer, and being capable of becoming a passive layer composed of the binding material under the application of a voltage thereto, and capable of coming into contact with a workpiece;

an electrode which is disposed so as to face the surface layer of the electroconductive grindstone with a predetermined distance therefrom, serving as a counter electrode for the electroconductive grindstone;

electroconductive fluid supplying means for supplying an electroconductive fluid between the surface layer of the electroconductive grindstone and the electrode for causing an electrolytic reaction to take place between the surface layer of the electroconductive grindstone and the electrode; and voltage application means for applying the voltage across the electroconductive grindstone and the electrode to cause the electrolytic reaction to take place between the surface layer of the electroconductive grindstone and the electrode, thereby grinding the workpiece with the electroconductive grindstone, while dressing the surface layer of the electroconductive grindstone by the electrolytic reaction during the course of the grinding of the workpiece.

In this electrolytic in-process dressing grinding apparatus, a passive layer is formed in the shape of a uniform and fine porous layer via a barrier in the surface layer of the electroconductive grindstone, so that the supporting force for the grains imparted thereto by the binding material and also by the passive layer is uniform in the surface layer in its entirety, and therefore, the protrusion of the grains is uniform in the entire surface of the grindstone. As a result, few scratches and cracks are formed in the surface of the grindstone, and therefore a ground surface with excellent surface roughness with mirror-surface-quality and high precision can be obtained by this grindstone.

Furthermore, the porosity of the porous layer formed on the barrier layer is uniform and fine and the passive layer can be quickly formed in the surface layer and therefore, the predressing time can be significantly reduced and the grinding time can also be significantly reduced, with remarkable improvement of the grinding efficiency.

The above-mentioned performance can be furthermore improved when the binding material consists essentially of aluminum.

An electrolytic in-process dressing grindstone of the present invention comprises a surface layer comprising abrasive grains and a binding material consisting of a single metal component, in which the grains are uniformly distributed and supported by the binding material, and can be subjected to dressing in the course of the grinding of the workpiece, or by an electrolytic in-process dressing grindstone for grinding a workpiece, comprising a surface layer which comprises abrasive grains and a binding material consisting of a single metal component and a material with a resistivity of 1 MΩ.cm or more, in which the abrasive grains are uniformly distributed and supported by the binding material, and can be subjected to dressing in the course of the grinding of the workpiece.

In the above-mentioned grindstone, when the binding material consists of a single metal component, no local-action-cells are formed in the binding material during grinding operation. In other words, when the binding material comprises two or more different metals, one of the metals becomes a positive electrode and the other metal becomes a negative electrode during the in-process dressing, so that the binding material locally corrodes, and therefore is excessively eluted. However, when the binding material consists of a single metal, no local-action-cells are formed in the binding material during the in-process dressing, so that the binding material is not excessively eluted, and accordingly chips, which may be otherwise formed by detaching of the grains from the grindstone, are rarely formed.

Therefore, a uniform and fine passive layer is formed in the surface layer of the grindstone, so that the supporting force for the grains imparted thereto by the binding material and also by the passive layer is uniform in the surface layer in its entirety, and therefore, the protrusion of the grains is uniform in the entire surface of the grindstone. As a result, scratches and cracks are prevented from being formed in the surface of the grindstone, and therefore a ground surface with excellent mirror-surface-quality roughness and high precision can be obtained by this grindstone.

For improving the above-mentioned performance, it is preferable that the single metal component for the binding material be pure aluminum or pure iron. When the binding material consists of pure aluminum or pure iron, the formation of local-action-cells in the binding material can be effectively prevented.

For imparting rigidity to the grindstone, preventing the grindstone from being destroyed or preventing a workpiece from being deformed during the grinding thereof, pure iron is better than pure aluminum as the material for the binding material.

When the binding material consists of a single metal component and a material with a resistivity of 1 MΩ.cm or more, no local-action-cells are formed in the binding material during the in-process dressing, so that the binding material is not excessively eluted and accordingly chips, which may be otherwise formed by detaching of the grains from the grindstone, are rarely formed.

Another electrolytic in-process dressing grinding method of the present invention comprises the steps of:

applying a voltage across (a) an electroconductive grindstone comprising a surface layer which comprises abrasive grains and a binding material consisting of a single metal component, or a binding material consisting of a single metal component and a material with a resistivity of 1 MΩ.cm or more, in which the abrasive grains are uniformly distributed and supported by the binding material, and can be subjected to dressing in the course of the grinding of the workpiece, and being capable of becoming a passive layer composed of the binding material under the application of the voltage thereto, and capable of coming into contact with a workpiece, and (b) an electrode which is disposed so as to face the surface layer of the electroconductive grindstone with a predetermined distance therefrom, serving as a counter electrode for the electroconductive grindstone, with an electroconductive fluid being supplied between the surface layer of the electroconductive grindstone and the electrode in such a manner that an electrolytic reaction can be caused to take place between the surface layer of the electroconductive grindstone and the electrode under the application of the voltage; and grinding the workpiece with the electroconductive grindstone, while dressing the surface layer of the electroconductive grindstone by the electrolytic reaction during the course of the grinding of the workpiece.

In the above-mentioned electrolytic in-process dressing grinding method, when the binding material consists of a single metal, no local-action-cells are formed in the binding material and therefore no local corrosion takes therein during the in-process dressing, so that the binding material is not excessively eluted.

Therefore, a uniform and fine passive layer is formed in the surface layer of the grindstone, so that the supporting force for the grains imparted thereto by the binding material and also by the passive layer is uniform in the surface layer in its entirety, and therefore, the protrusion of the grains is uniform in the entire surface of the grindstone. As a result, scratches and cracks are prevented from being formed in the surface of the grindstone, and therefore a ground surface with excellent mirror-surface-quality roughness and high precision can be obtained by this electrolytic in-process dressing grinding method.

For improving the above-mentioned performance, it is preferable that the single metal component for the binding material be pure aluminum or pure iron, or that the binding material consist of a single metal component and a material with a resistivity of 1 MΩ.cm or more.

When the binding material consists of pure aluminum or pure iron, or consists of a single metal component and a material with a resistivity of 1 MΩ.cm or more, the formation of local-action-cells in the binding material can be more effectively prevented. Examples of a material with a resistivity of 1 MΩ.cm or more include, but are not limited to, silicon powder, alumina, and quartz glass.

Furthermore, in the above-mentioned electrolytic in-process grinding method, the electroconductive fluid may comprise a halogen ion, such as chlorine ion, with a concentration in the range of 10 ppm to 40 ppm. The degree of the dressing can be adjusted by changing the concentration of the halogen ion in the electroconductive fluid, whereby the elusion of the binding material can be appropriately adjusted, and therefore scratches and cracks are prevented from being formed in the surface of the grindstone, and therefore a ground surface with higher surface quality and higher precision can be stably obtained.

Another electrolytic in-process dressing grinding apparatus of the present invention comprises:

an electroconductive grindstone comprising a surface layer which comprises abrasive grains and a binding material consisting of a single metal component, or a binding material consisting of a single metal component and a material with a resistivity of 1 MΩ.cm or more, in which the abrasive grains are uniformly distributed and supported by the binding material, and can be subjected to dressing in the course of the grinding of the workpiece, and being capable of becoming a passive layer composed of the binding material under the application of the voltage thereto, and capable of coming into contact with a workpiece;

an electrode which is disposed so as to face the surface layer of the electroconductive grindstone with a predetermined distance therefrom, serving as a counter electrode for the electroconductive grindstone, with an electroconductive fluid being supplied between the surface layer of the electroconductive grindstone and the electrode in such a manner that an electrolytic reaction can be caused to take place between the surface layer of the electroconductive grindstone and the electrode under the application of the voltage;

electroconductive fluid supplying means for supplying an electroconductive fluid between the surface layer of the electroconductive grindstone and the electrode for causing an electrolytic reaction to take place between the surface layer of the electroconductive grindstone and the electrode; and voltage application means for applying the voltage across the electroconductive grindstone and the electrode to cause the electrolytic reaction to take place between the surface layer of the electroconductive grindstone and the electrode, thereby grinding the workpiece with the electroconductive grindstone, while dressing the surface layer of the electroconductive grindstone by the electrolytic reaction during the course of the grinding of the workpiece.

In the above-mentioned electrolytic in-process dressing grinding apparatus, when the binding material consists of a single metal, no local-action-cells are formed in the binding material and therefore no local corrosion takes therein during the in-process dressing, so that the binding material is not excessively eluted.

Therefore, a uniform and fine passive layer is formed in the surface layer of the grindstone, so that the supporting force for the grains imparted thereto by the binding material and also by the passive layer is uniform in the surface layer in its entirety, and therefore, the protrusion of the grains is uniform in the entire surface of the grindstone. As a result, scratches and cracks are prevented from being formed in the surface of the grindstone, and therefore a ground surface with excellent mirror-surface-quality roughness and high precision can be obtained by this grindstone.

For improving the above-mentioned performance, it is preferable that the single metal component for the binding material be pure aluminum or pure iron, or that the binding material consist of a single metal component and a material with a resistivity of 1 MΩ.cm or more, since when such a binding material is employed, the formation of local-action-cells in the binding material can be more effectively prevented.

Other features of this invention will become apparent in the course of the following description of exemplary embodiments, which are given for illustration of the invention and are not intended to be limiting thereof.

In FIG. 1, reference numeral 10 indicates a machining center in which there is provided a grinding wheel 11 made of an electroconductive grindstone. Furthermore, a workpiece 13 made of quench-hardened steel is mounted on a grinding table 12 of the machining center 10. The grinding wheel 11 has a contact surface 11*a* which comes into contact with the workpiece 13.

An electrode 14 is disposed so as to face the contact surface 11*a* of the grinding wheel 11 with a predetermined distance between the electrode 14 and the contact surface 11*a*. A power supply brush 15 is attached to the grinding wheel 11, so that the grinding wheel 11 is set so as to be a positive electrode and the electrode 14 is set so as to be a negative electrode serving as a counter electrode for the grinding wheel 11.

A voltage is applied between the electrode 14 and the power supply brush 15 by a power source 16, so that a predetermined voltage is applied between the grinding wheel 11 and the electrode 14.

Above the grinding wheel 11, there is disposed a nozzle 17 through which an electroconductive fluid is caused to flow between the grinding wheel 11 and the electrode 14, so that the workpiece 13 is ground by the grinding wheel 11 as the contact surface 11*a* of the grinding wheel 11 is being dressed by an electrolytic reaction which is caused to take place with the application of a voltage between the grinding wheel 11 and the electrode 14 by the power source 16 while the electroconductive fluid is caused to flow from the nozzle 17 between the grinding wheel 11 and the electrode 11.

The grinding wheel 11 comprises fine abrasive grains and a binding material which consists essentially of aluminum.

When the grinding wheel 11 is being dressed, the electric resistance between the grinding wheel 11 and the electrode 14 is so small that relatively large electric current flows through the binding material of the grinding wheel 11. At this moment, a metallic portion of the surface of the grinding wheel 11 is eluted by the electrolytic effect so that non-conductive grains protrude.

Figure 2:
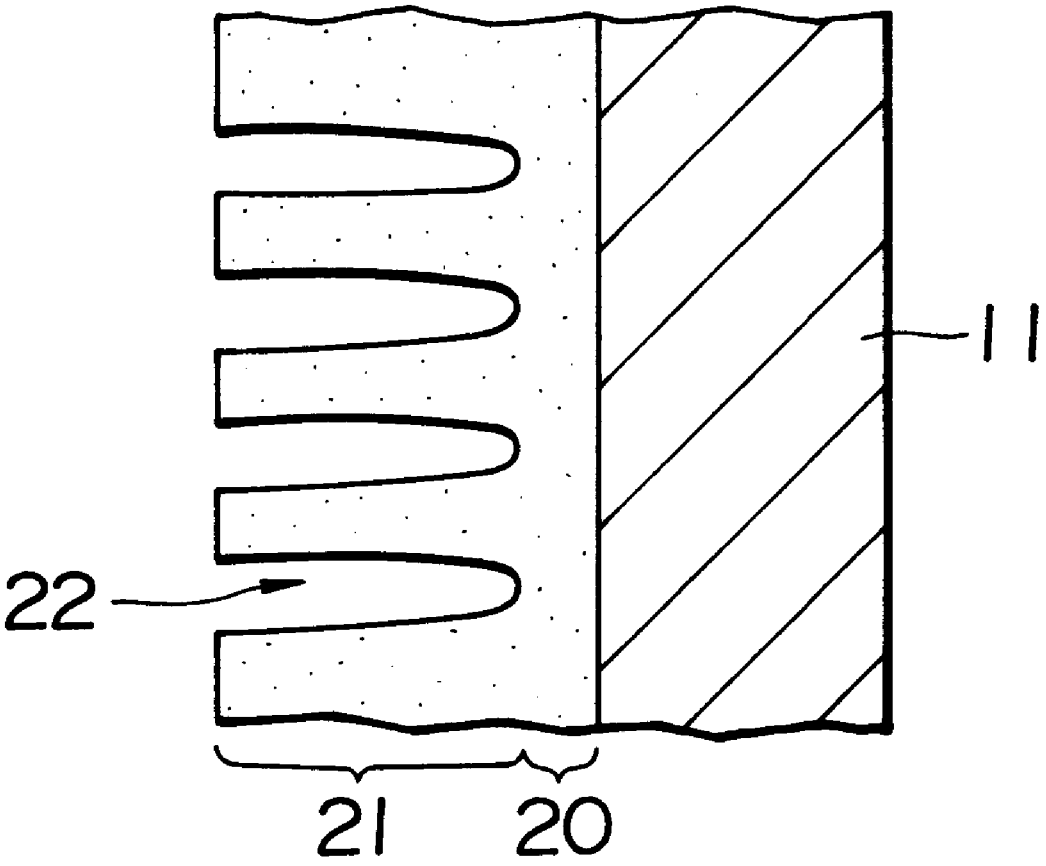
FIG. 2 is a schematic cross-sectional view of a passive layer formed on an aluminum surface layer in a grindstone of the present invention.

With further application of the voltage, a passive film composed of a porous layer 21 having a number of uniform and fine pores 22 is formed on a barrier layer 20 as illustrated in FIG. 2, so that the electric resistance between the grinding wheel 11 and the electrode 14 increases.

Therefore, the electric current which flows between the grinding wheel 11 and the electrode 14 decreases, so that eventually the protrusion of the grains (that is, the dressing of the grinding wheel 11) is substantially stopped.

When the grinding of the workpiece 13 is initiated by the grinding wheel 11 in the above-mentioned state and continued, the grains and the passive layer begin to be worn out in the course of the grinding, and with further continuation of grinding, the passive layer at the contact surface 11*a* of the grinding wheel 11 is worn out or eliminated.

As a result, the electric resistivity of the grinding wheel 11 is increased, and the electric current between the grinding wheel 11 and the electrode 14 increases, and accordingly the elusion of the metallic portion at the contact surface 11*a* of the grinding wheel 11 increases, so that the protrusion of the grains (that is, the dressing of the grinding wheel 11) is resumed.

Thus, excessive elusion of the metallic portion is prevented by the formation and elimination of the passive layer, so that the dressing of the grinding wheel 11 is automatically adjusted.

In the example of the present invention as shown in FIGS. 1 and 2, the surface roughness of the workpiece 13 was inspected. The result was that the center-line mean roughness was 0.2 to 0.25 $\mu$mRa, and the maximum height was 1.1 to 1.5 $\mu$mRmax as shown in FIG. 3(*a*).

Figure 3A:
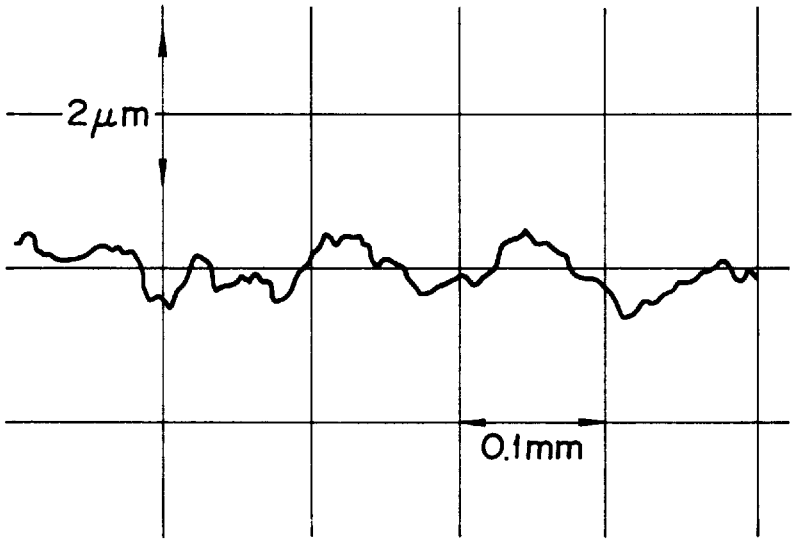
FIG. 3(*a*) is a diagram showing the surface roughness of a workpiece ground by an example of an electrolytic in-process dressing grinding apparatus of the present invention.
Figure 3B:
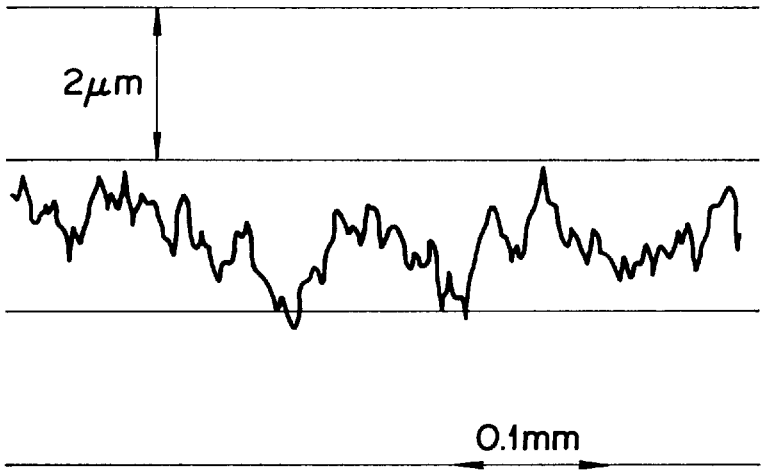

In contrast to this, when the same workpiece made of quench-hardened steel was ground by a conventional grinding wheel comprising a binding material which comprises an iron-based metallic material as the main component and a metallic additive, the center-line mean roughness was 0.4 to 0.5 $\mu$mRa, and the maximum height was 2.1 to 3.0 $\mu$mRmax as shown in FIG. 3(*b*).

Thus, the grinding performance of the present invention employing the ELID-grinding method is about 2 times better than that attained by the conventional method.

Figure 4:
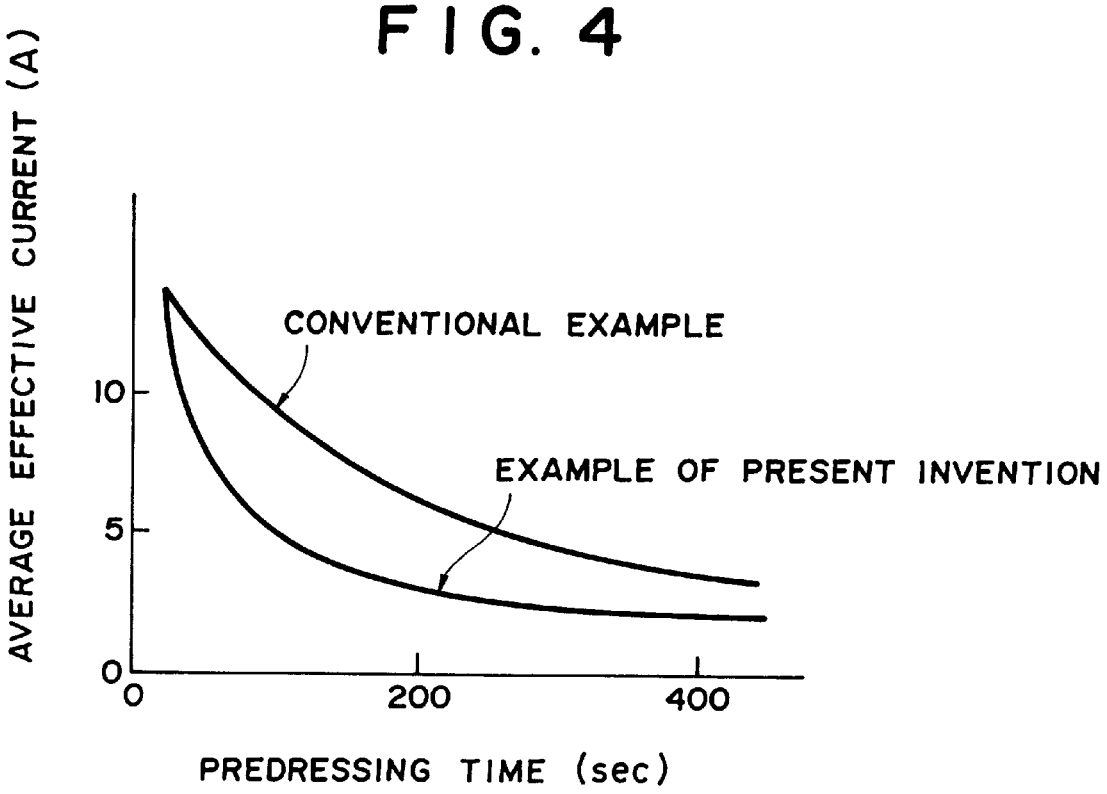
FIG. 4 is a graph showing the relationship between the predressing time (sec.) of a grinding wheel of the present invention, and that of a conventional grinding wheel.

FIG. 4 shows the relationship between the predressing time (sec.) of the grinding wheel 11 of the present invention and the changes in the average effective current (A) which flows between the grinding wheel 11 of the present invention and the electrode 14; and the relationship between the predressing time (sec.) of the above-mentioned conventional grinding wheel and the changes in the average effective current (A) which flows between the conventional grinding wheel and the electrode 14. FIG. 4 demonstrates that the predressing time (sec.) of the grinding wheel 11 of the present invention is about one-half the predressing time (sec.) of the conventional grinding wheel, so that the grinding wheel 11 of the present invention is capable of performing the dressing much more effectively than the conventional grinding wheel.

In the above mentioned example according to the present invention, there is employed in the grinding wheel 11 the binding material which consists essentially of aluminum, which is capable of forming the passive layer composed of the porous layer 21 having uniform and fine pores 22 provided on the barrier layer 20 in the surface layer of the grinding wheel 11, so that the supporting force for the grains imparted thereto by the binding material and the passive layer can be made uniform in the entirety of the grinding wheel 11, whereby the uniform protrusion of the grains can be attained. As a result, the formation of scratches and cracks in the grinding wheel 11 can be effectively prevented, and the workpiece 13 can be ground so as to have high mirror-surface-quality ground surface.

Furthermore, according to the present invention, the porous layer 21 with uniform and fine pores 22 can be formed so that the passive layer can be formed very quickly on the contact surface 11*a* of the grinding wheel 11, and therefore, the predressing time can be significantly shortened and accordingly grinding time can also be considerably shortened with higher grinding efficiency in comparison with the grinding efficiency of the conventional grinding method.

In the above-mentioned example of the electrolytic in-process dressing grinding apparatus, the machining center 10 is employed as the dressing grinder, but the grinder and the workpiece are not respectively limited to the above explained grinder and workpiece as long as the ELID-grinding can be performed.

Figure 5:
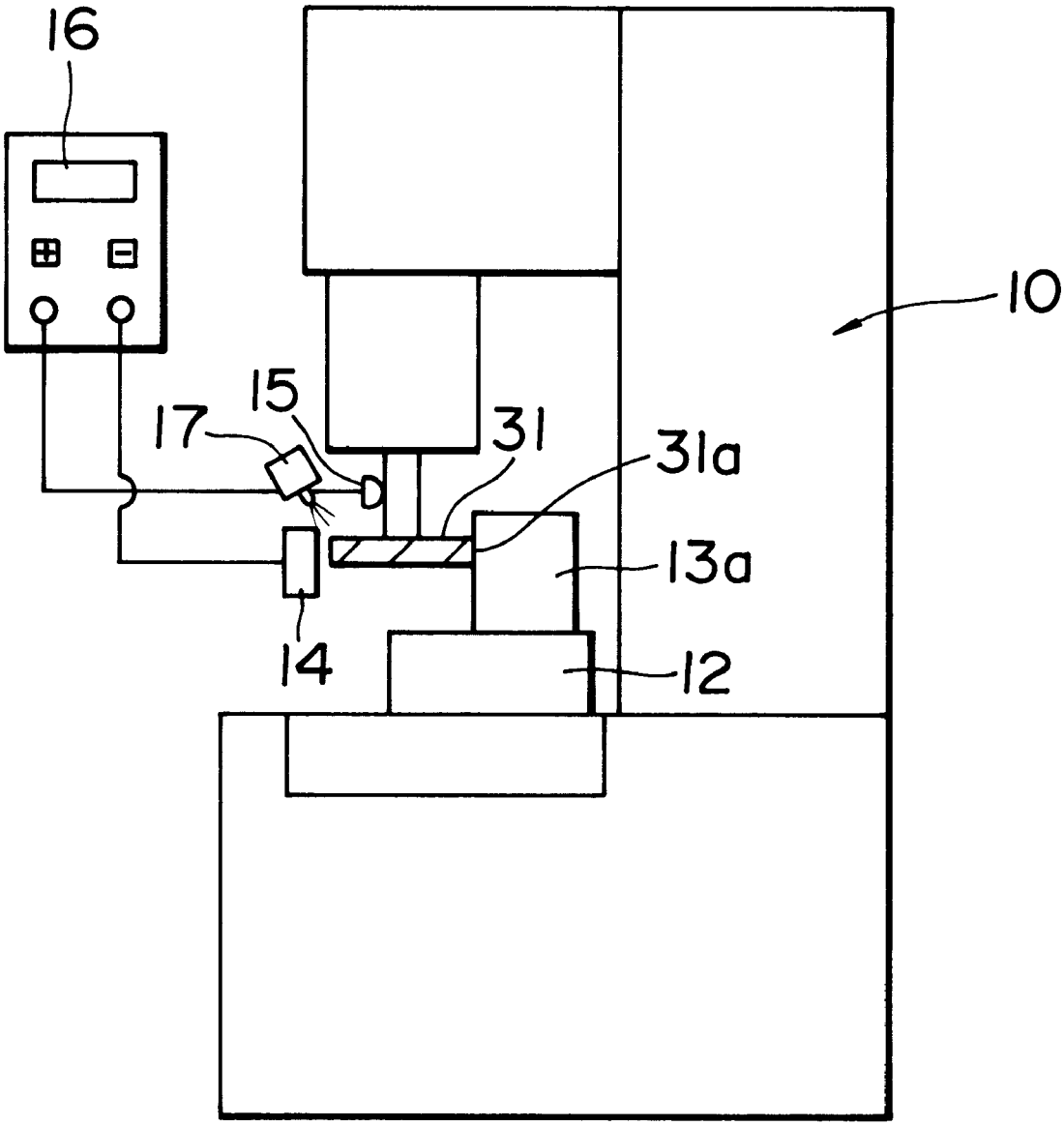
FIG. 5 is a schematic cross-sectional view of another example of an electrolytic in-process dressing grinding apparatus of the present invention.

FIG. 5 shows another electrolytic in-process dressing grinding apparatus which is the same as that shown in FIG. 1 except that the grinding wheel 11 is replaced by a grinding wheel 31 which comprises fine abrasive grains and a binding material for binding the grains, consisting of a single metal component such as pure aluminum or pure iron; or consisting of a single metal component and a material with a resistivity of 1 MΩ.cm or more.

When the dressing of the grinding wheel 31 is performed, an electroconductive fluid comprising a halogen ion, such as chlorine ion, with a concentration in the range of 10 ppm to 40 ppm is caused to flow between the grinding wheel 31 and the electrode 14, with the application of a predetermined voltage between the grinding wheel 31 and the electrode 14 by the power source 16, so that the contact surface 31*a* of the grinding wheel 31 is subjected to dressing by the electrolytic reaction, and the degree of the dressing is adjusted by changing the concentration of the halogen ion in the electroconductive fluid.

At the electrolytic predressing of the grinding wheel 31, the electric resistance between the grinding wheel 31 and the electrode 14 is small, so that relatively large electric current flows through the binding material of the grinding wheel 31. At this moment, a metallic portion of the surface of the grinding wheel 31 is eluted by the electrolytic effect so that nonconductive grains protrude.

With further application of the voltage, a passive film composed of a porous layer 21 having a number of uniform and fine pores 22 is formed on a barrier layer 20 as illustrated in FIG. 2, so that the electric resistance between the grinding wheel 31 and the electrode 14 increases.

Therefore, the electric current which flows between the grinding wheel 31 and the electrode 14 decreases, so that eventually the protrusion of the grains (that is, the dressing of the grinding wheel 31) is substantially stopped.

When the grinding of the workpiece 13 is initiated by the grinding wheel 31 in the above-mentioned state and continued, the grains and the passive layer begin to be worn out in the course of the grinding, and with further continuation of grinding, the passive layer at the contact surface 11*a* of the grinding wheel 31 is worn out or eliminated, the electric resistivity of the grinding wheel 31 is increased, and the electric current between the grinding wheel 31 and the electrode 14 increases, and accordingly the elusion of the metallic portion at the contact surface 31*a* of the grinding wheel 31 increases, so that the protrusion of the grains (that is, the dressing of the grinding wheel 31) is resumed.

Thus, excessive elusion of the metallic portion is prevented by the formation and elimination of the passive layer, so that the dressing of the grinding wheel 31 is automatically adjusted.

In the above-mentioned grinding wheel 31, when the binding material consists of a single metal component such as pure aluminum or pure iron, or consists of a single metal component and a material with a resistivity of 1 MΩ.cm or more, the formation of local-action-cells in the binding material is prevented during grinding operation. In other words, when the binding material comprises two or more different metals, one of the metals becomes a positive electrode and the other metal becomes a negative electrode during the in-process dressing, so that the binding material locally corrodes, and therefore is excessively eluted. However, when the binding material consists of a single metal or consists of a single metal component and a material with a resistivity of 1 MΩ.cm or more as mentioned above, no local-action-cells are formed in the binding material during the in-process dressing, so that the binding material is not excessively eluted, and accordingly chips, which may be otherwise formed by detaching of the grains from the grindstone, are rarely formed.

Therefore, a uniform and fine passive layer is formed in the contact surface 31*a* of the grinding wheel 31, so that the supporting force for the grains imparted thereto by the binding material and also by the passive layer is uniform in the contact surface 31*a* in its entirety, and therefore, the protrusion of the grains is uniform in the entire surface of the grinding wheel 31. As a result, scratches and cracks are prevented from being formed in the surface of the grind wheel 31, and therefore a ground surface with excellent surface roughness with mirror-surface-quality and high precision can be stably obtained by the grinding wheel 31.

Figure 6A:
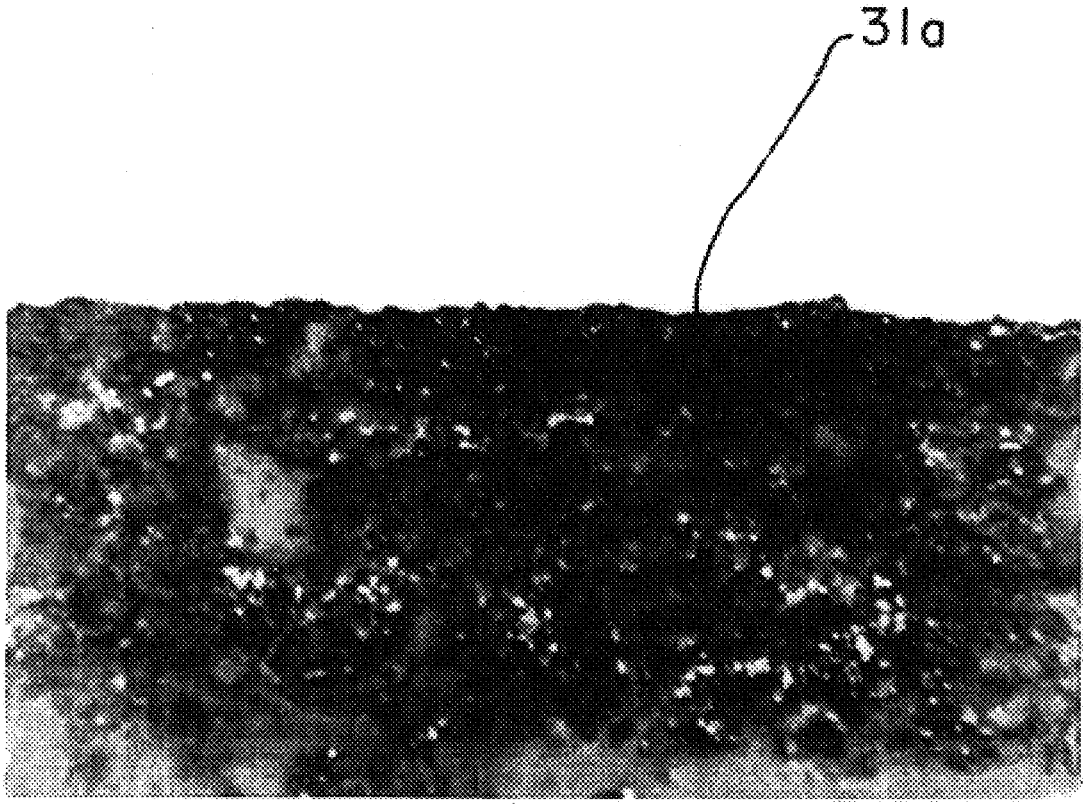
FIG. 6(*a*) is a cross-sectional view of a contact surface of a grinding wheel of the present invention which comprises a binding material consisting of pure aluminum after being subjected to electrolytic in-process dressing.
Figure 6B:
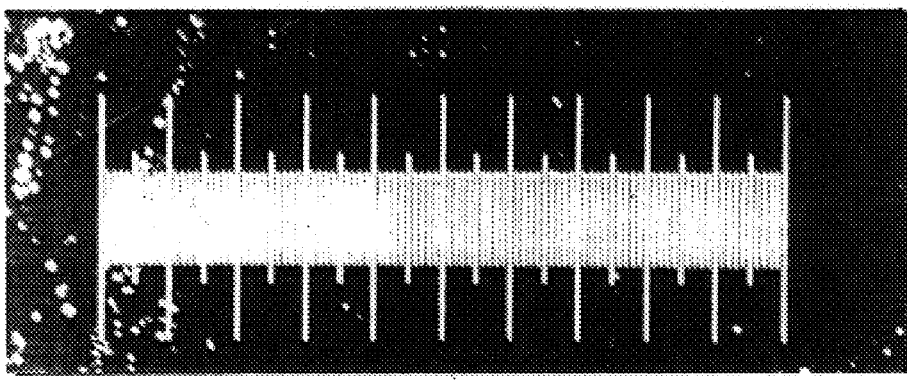

FIG. 6(*a*) shows a cross-sectional view of the contact surface 31*a* of the grinding wheel 31 which comprises a binding material consisting of pure aluminum after being subjected to the previously mentioned electrolytic in-process dressing.

FIG. 6(*b*) shows an enlarged scale with a total length of 1 mm, which can be commonly employed for use with FIGS. 6(*a*), 7(*a*), 7(*b*), 8(*a*) and 8(*b*).

Figure 7A:
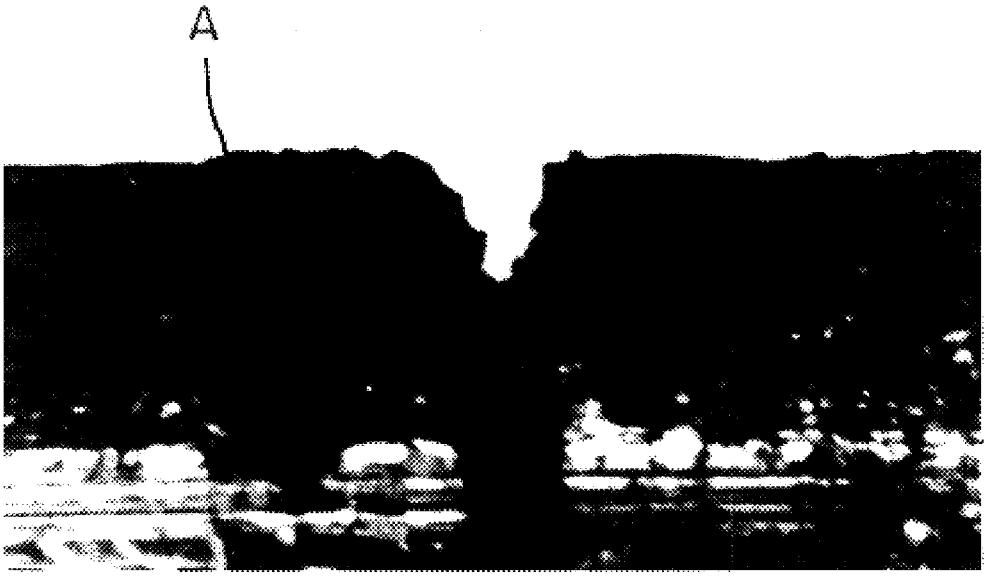
FIG. 7(*a*) is a cross-sectional view A of the contact surface of a comparative grinding wheel which comprises a binding material consisting of aluminum and copper after being subjected to the electrolytic in-process dressing.
Figure 7B:
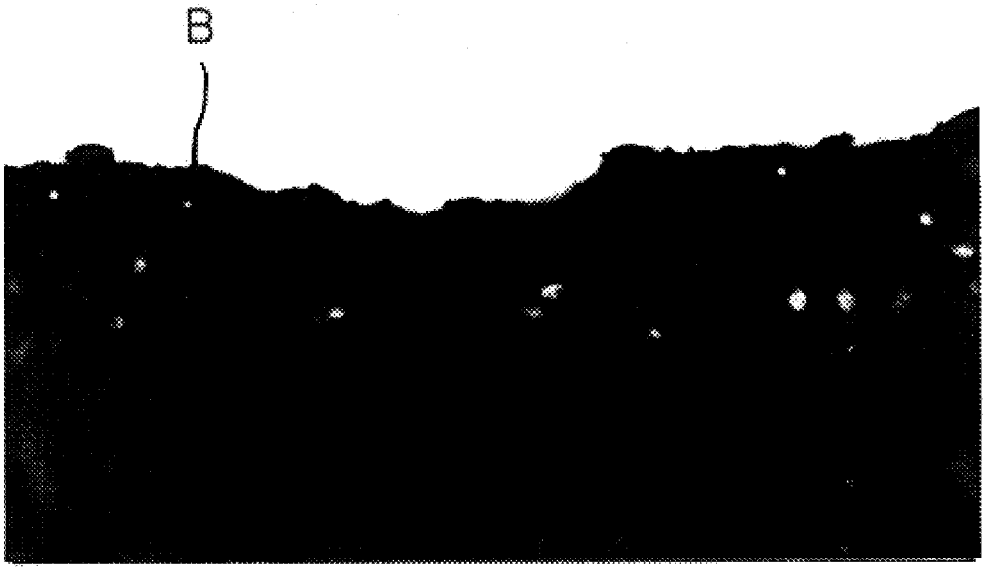

FIG. 7(*a*) shows a cross-sectional view A of the contact surface of a comparative grinding wheel which comprises a binding material consisting of aluminum and copper after being subjected to the previously mentioned electrolytic in-process dressing.

FIG. 7(*b*) shows a cross-sectional view B (which is different from the cross-sectional view A) of the contact surface of the same comparative grinding wheel as in FIG. 7(*a*) which comprises a binding material consisting of aluminum and copper after being subjected to the previously mentioned electrolytic in-process dressing.

The grinding wheel 31 which comprises a binding material consisting of pure aluminum maintains a smooth contact surface even after the electrolytic in-process dressing as shown in FIG. 6(*a*), while the grinding wheels shown in FIGS. 7(*a*) and 7(*b*) include local corrosion in the respective contact surfaces thereof.

The above results demonstrate that a uniform passive layer is formed in the grinding wheel 31 shown in FIG. 6(*a*) which comprises a binding material consisting of pure aluminum.

Figure 8A:
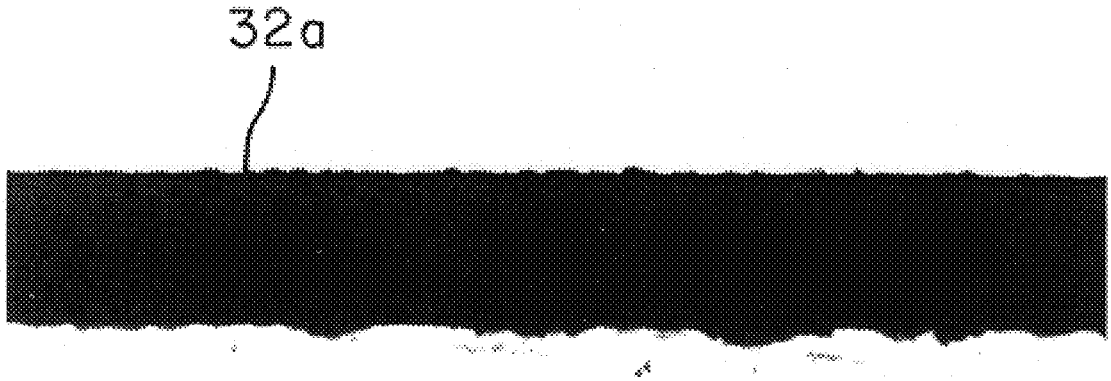
FIG. 8(*a*) shows a groove formed in a workpiece made of glass by use of a conventional grinding wheel which comprises a binding material consisting of aluminum and nickel by electrolytic in-process dressing cutting.
Figure 8B:
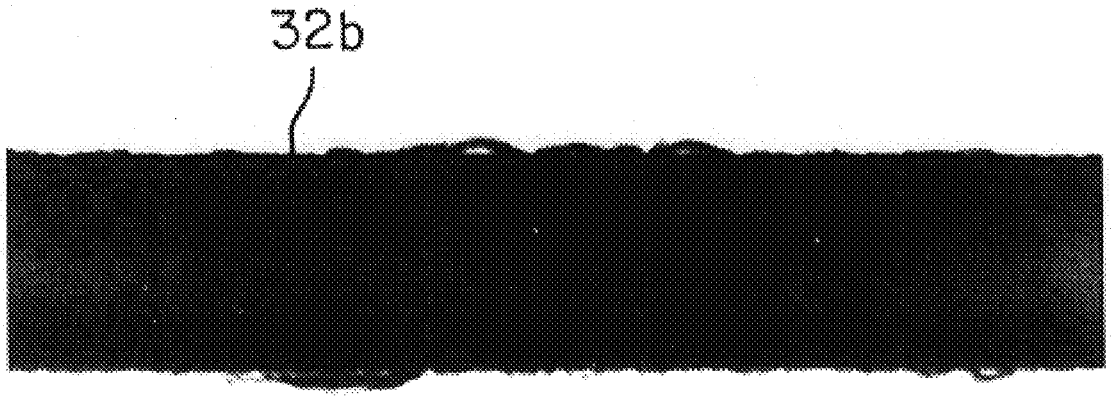

FIG. 8(*a*) is a cross-sectional view of a groove 32*a* formed in a workpiece made of glass by a grinding wheel which comprises a binding material consisting of aluminum and nickel by electrolytic in-process dressing cutting.

FIG. 8(*b*) is a cross-sectional view of a groove 32*b* formed in a workpiece made of glass by a grinding wheel which comprises a binding material consisting of aluminum and copper by electrolytic in-process dressing cutting.

Figure 9A:
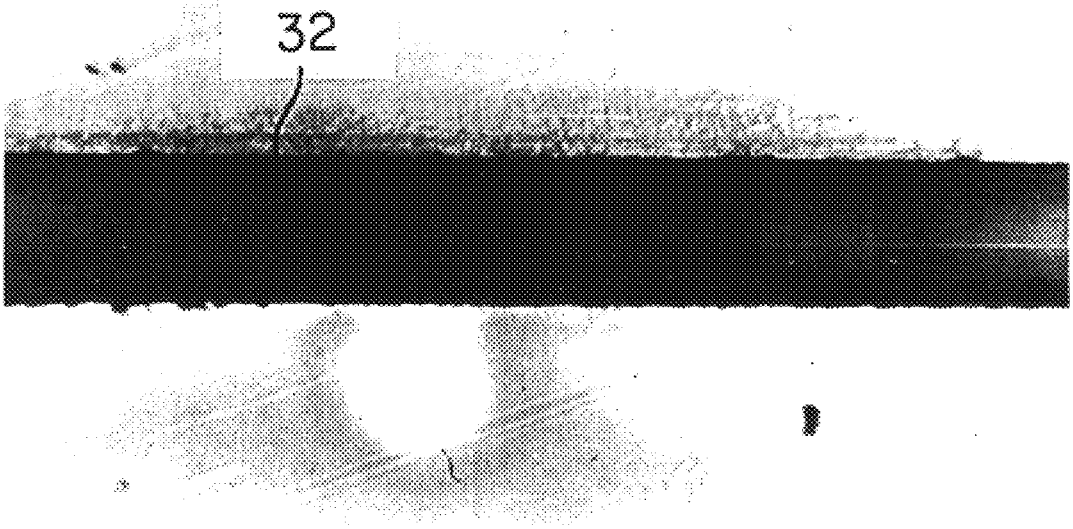
FIG. 9(*a*) shows a groove formed in a workpiece made of glass by use of a grinding wheel of the present invention which comprises a binding material consisting of aluminum by electrolytic in-process dressing cutting.
Figure 9B:
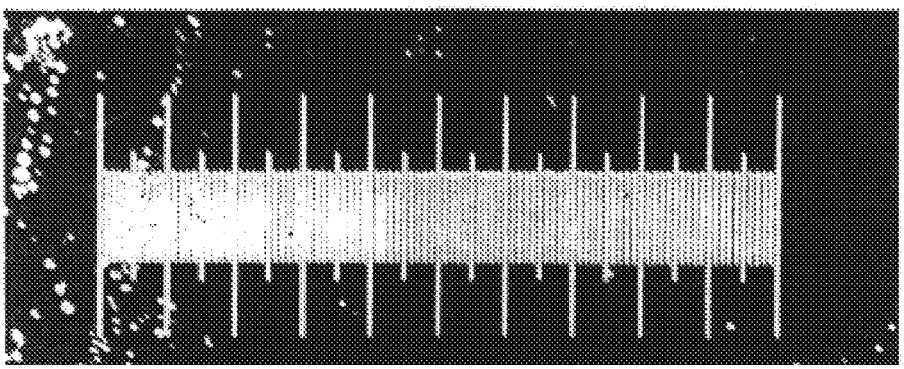

FIG. 9(*a*) is a cross-sectional view of a groove 32 formed in a workpiece made of glass by a grinding wheel which comprises a binding material consisting of aluminum by electrolytic in-process dressing cutting.

FIG. 9(*b*) shows the same enlarged scale with a total length of 1 mm as shown in FIG. 6(*b*), which can be commonly employed for FIGS. 9(*a*), 10(*a*) and 10(*b*).

In the above-mentioned electrolytic in-process dressing cutting for the formation of the grooves 32*a*, 32*b* and 32 respectively shown in FIG. 8(*a*), FIG. 8(*b*) and FIG. 9(*a*), an electroconductive fluid containing chlorine ion in a concentration of 20 ppm was employed.

The groove 32 shown in FIG. 9 formed by the grinding wheel which comprises a binding material consisting of pure aluminum has a smoother ground surface free from chips, with higher quality than those of the grooves 32*a* and 32*b* which are respectively shown in FIG. 8(*a*) and FIG. 8(*b*), and were respectively formed by the grinding wheel which comprises a binding material consisting of a mixture of aluminum and nickel, and by the grinding wheel which comprises a binding material consisting of a mixture of aluminum and copper.

Figure 10A:
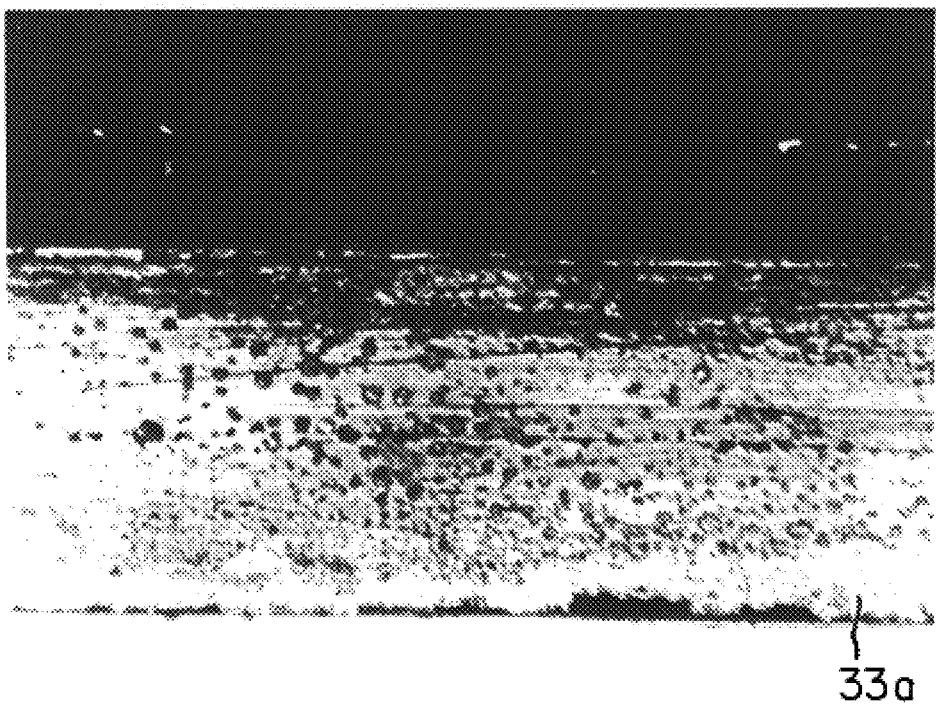
FIG. 10(*a*) shows a cross section formed in a workpiece made of glass by a conventional grinding wheel which comprises a binding material consisting of aluminum and nickel by electrolytic in-process dressing cutting.
Figure 10B:
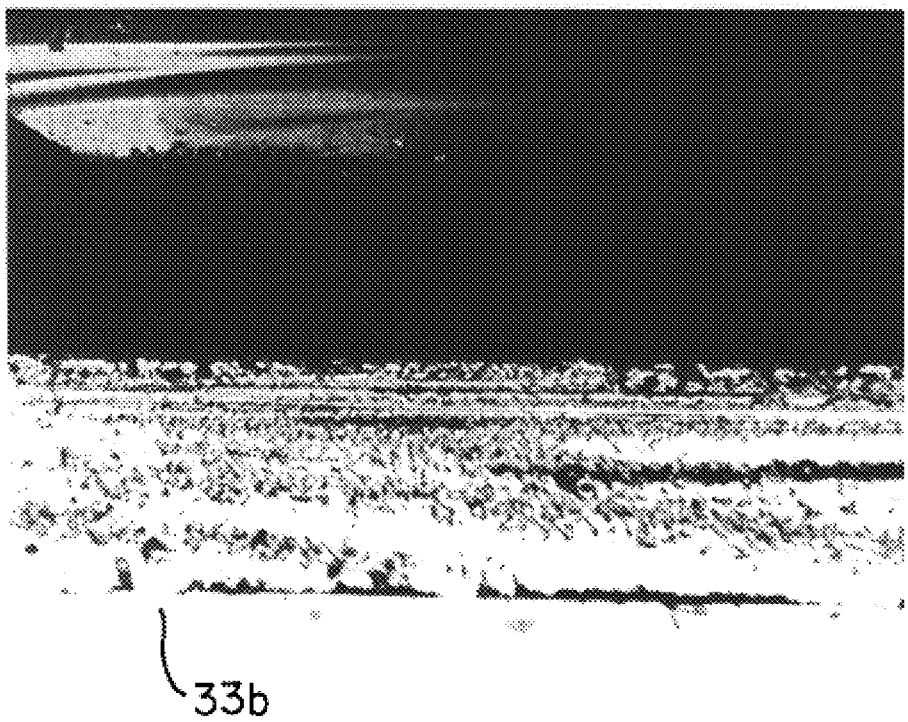

FIG. 10(*a*) shows a cross-section 33*a* formed in a workpiece made of glass by a grinding wheel which comprises a binding material consisting of aluminum and nickel by electrolytic in-process dressing cutting.

FIG. 10(*b*) shows a cross-sectional 33*b* formed in the workpiece made of glass by a grinding wheel which comprises a binding material consisting of aluminum and copper by electrolytic in-process dressing cutting.

Figure 11A:
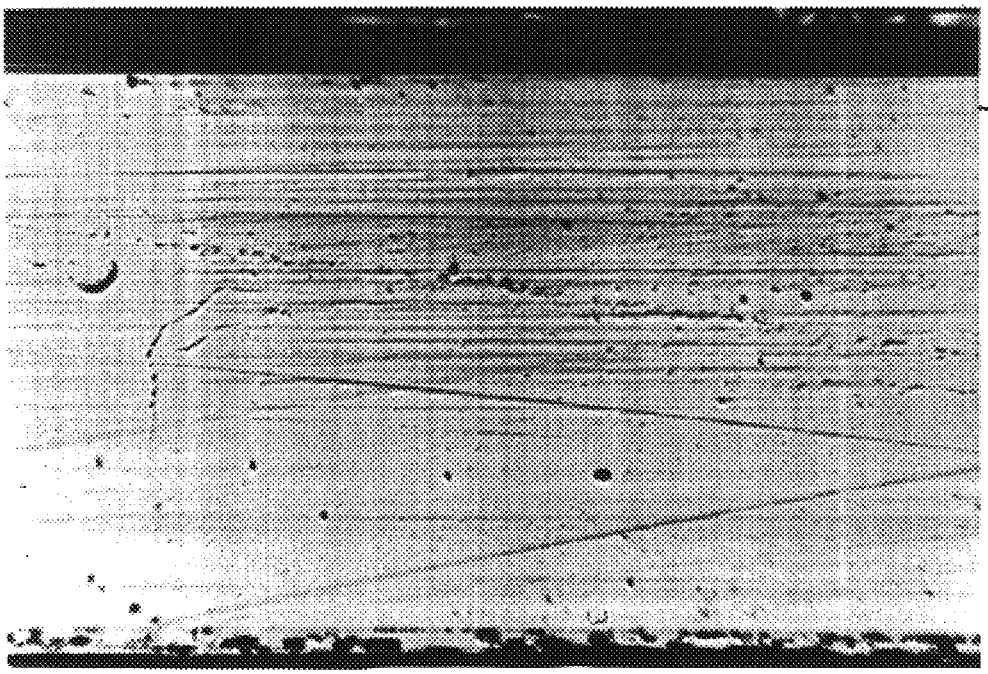
FIG. 11(*a*) is a cross section formed in the workpiece made of glass by a grinding wheel of the present invention which comprises a binding material consisting of aluminum by electrolytic in-process dressing cutting.
Figure 11B:
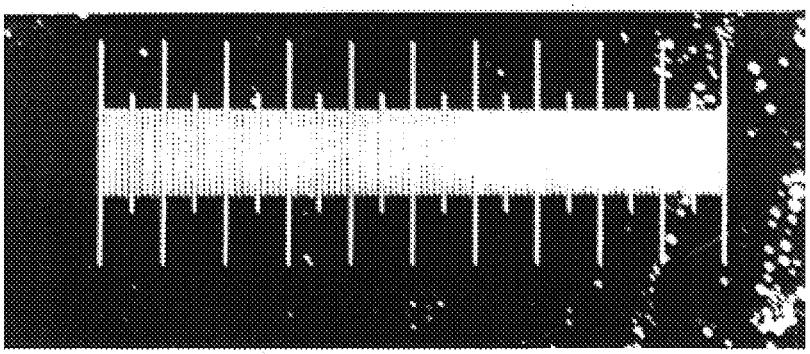
Figure 12A:
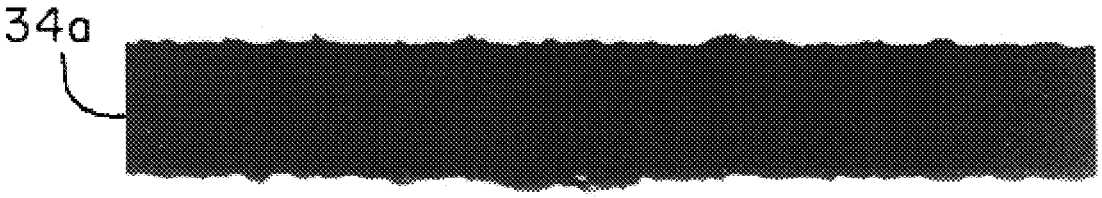
FIG. 12(*a*) shows a groove formed by use of an electroconductive fluid with a chlorine ion concentration of 30 ppm.
Figure 12B:
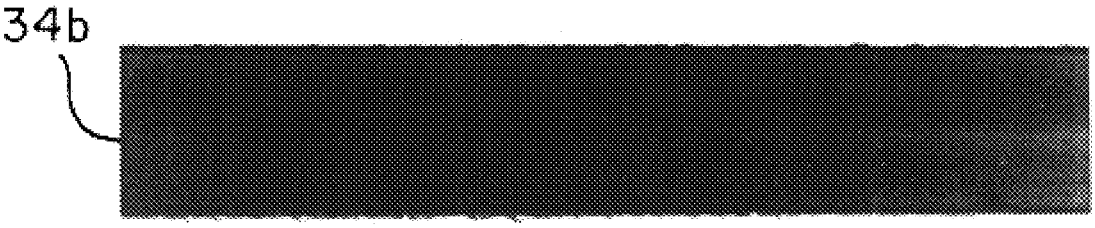
Figure 12C:
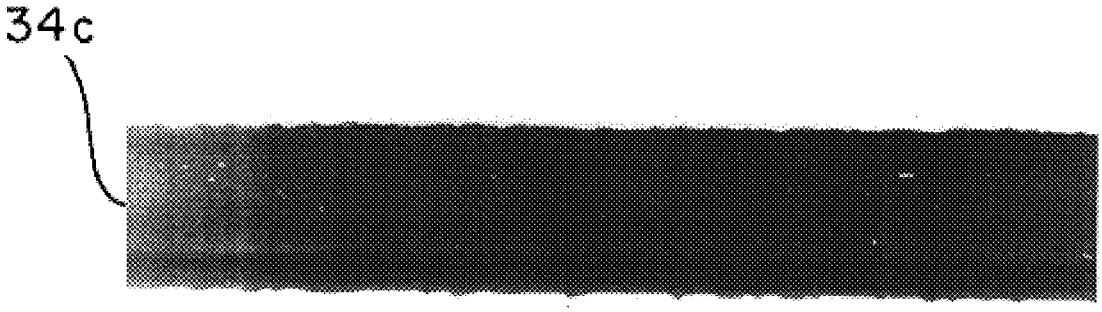
Figure 12D:
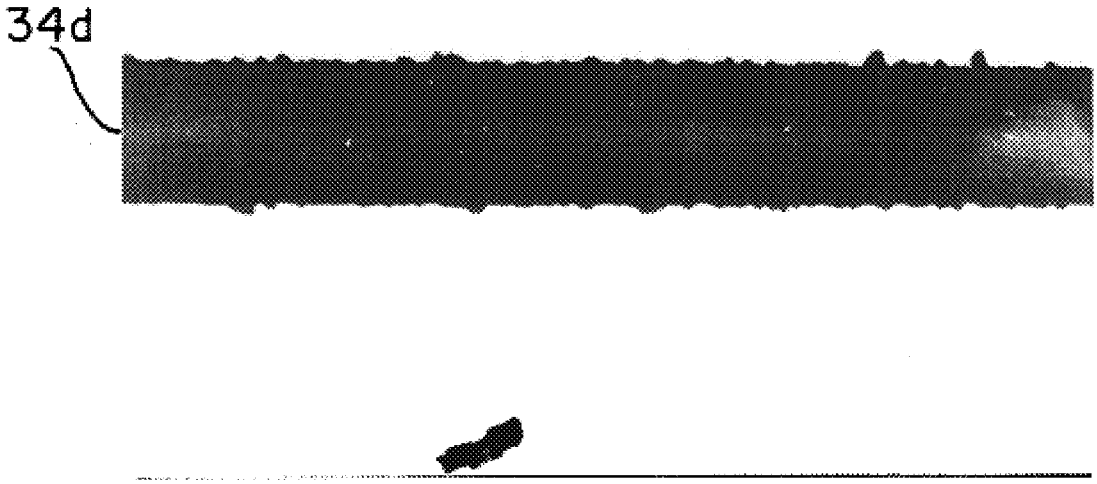
Figure 13A:
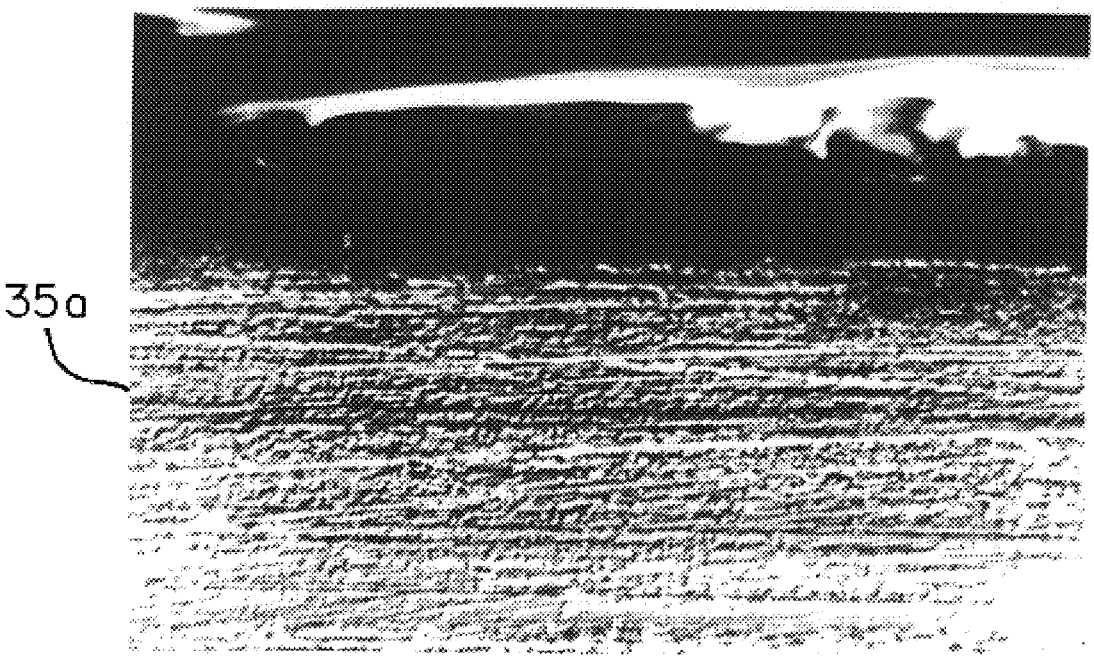
FIG. 13(*a*) shows a cross section formed by use of an electroconductive fluid with a chlorine ion concentration of 30 ppm.
Figure 13B:
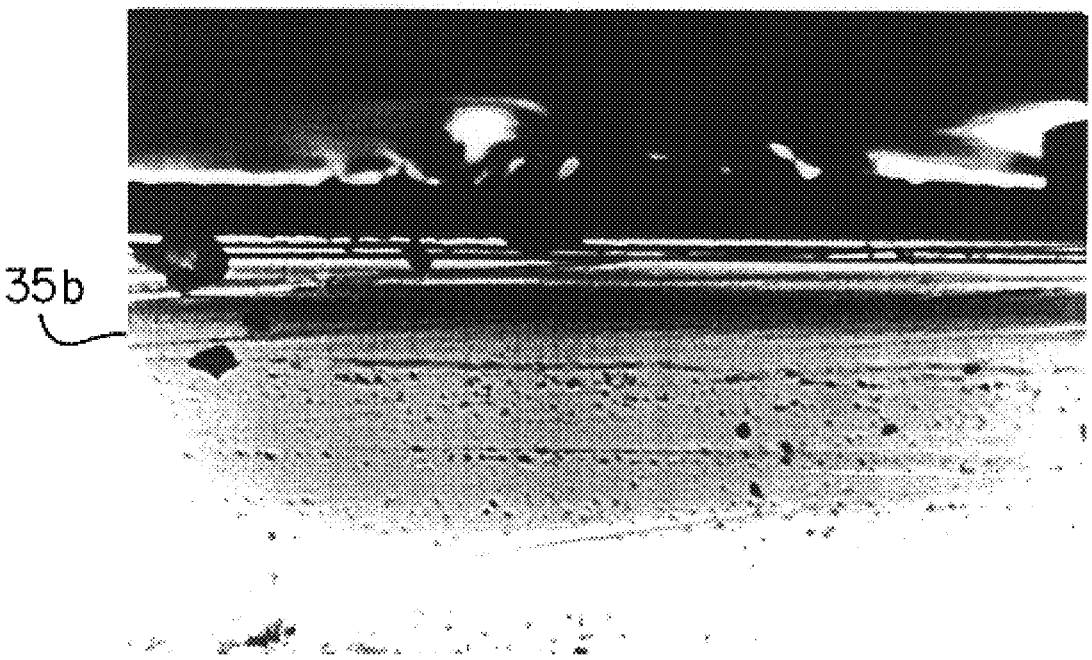
Figure 13C:
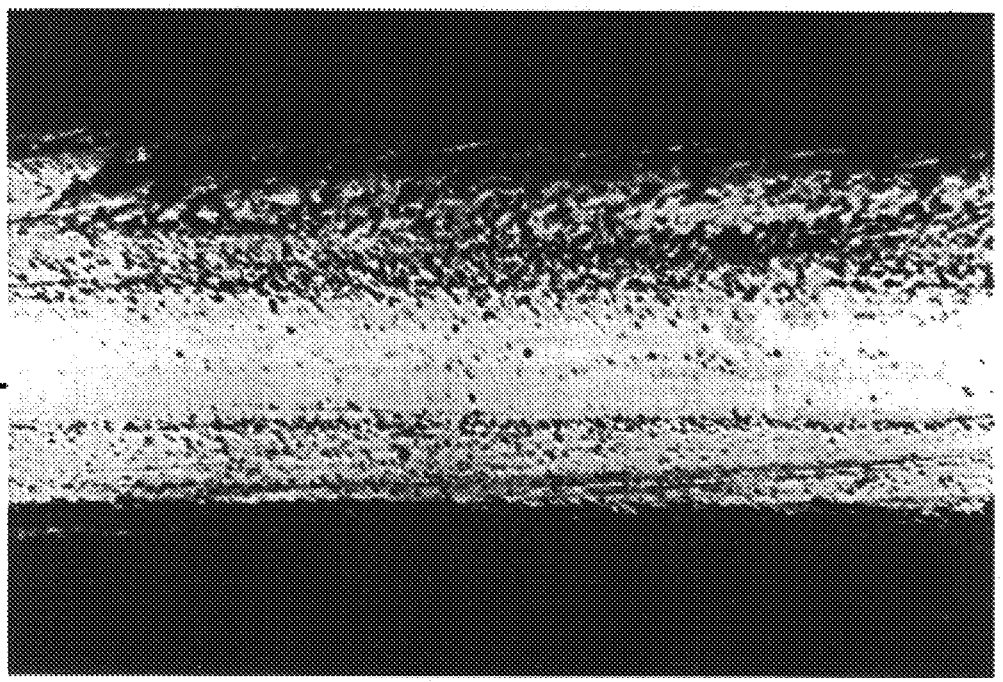
Figure 13D:
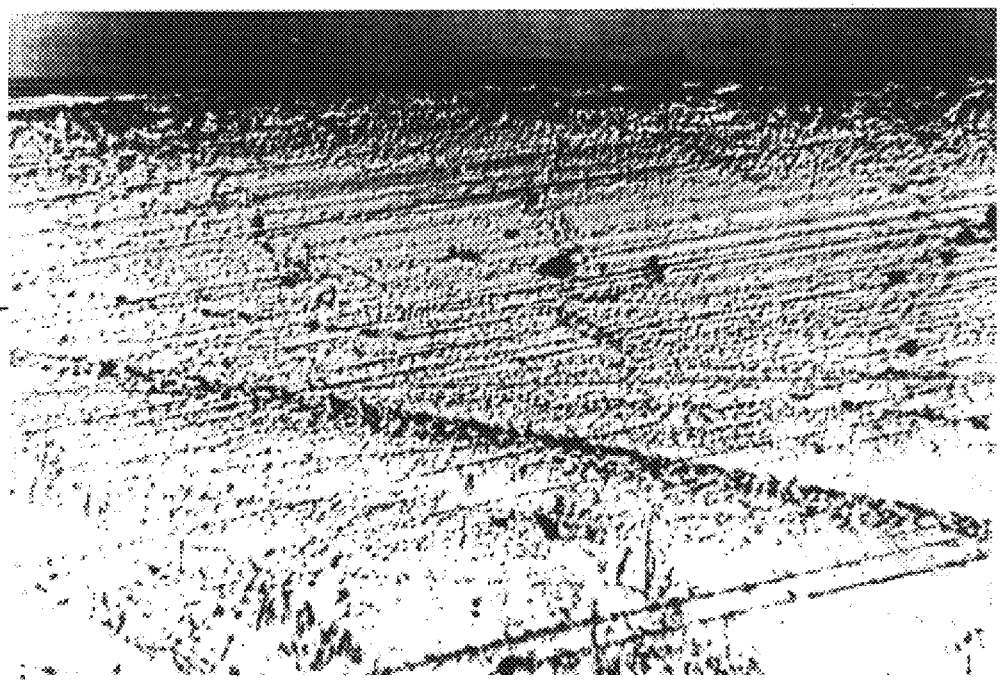
Figure 14:
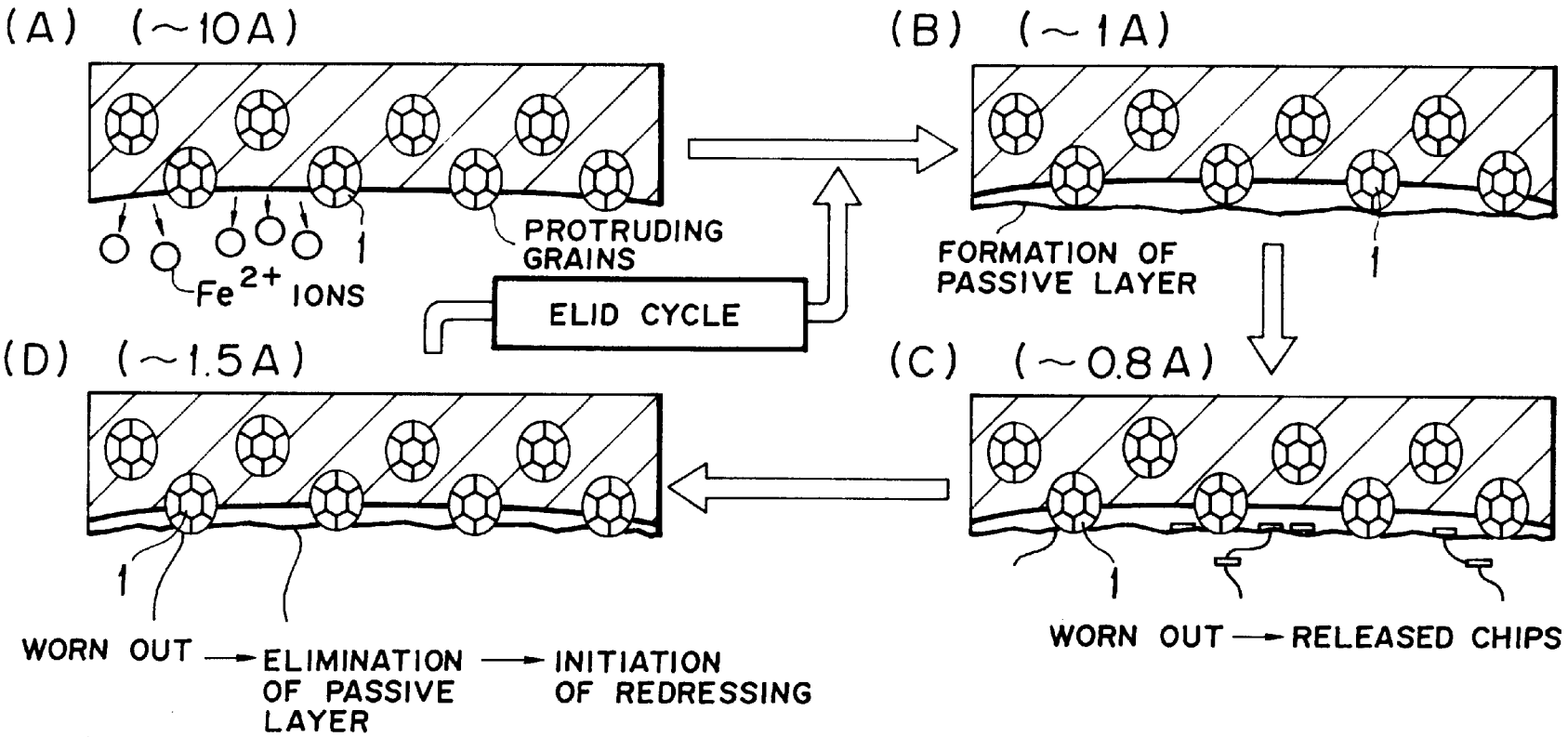
FIG. 14 is a schematic diagram showing the dressing mechanism in the ELID-grinding method.

FIG. 11(*a*) is a cross-section 33 formed in the workpiece made of glass by a grinding wheel which comprises a binding material consisting of aluminum by electrolytic in-process dressing cutting.

FIG. 11(*b*) shows the same enlarged scale with a total length of 1 mm as shown in FIG. 6(*b*), which can be commonly employed for FIGS. 11(*a*), 12(*a*), 12(*b*), 13(*a*), 13(*b*), 14(*a*), 14(*b*), 15(*a*) and 15(*b*).

In the above-mentioned electrolytic in-process dressing cutting for the formation of the cross-sections 33*a*, 33*b* and 33 respectively shown in FIG. 10(*a*), FIG. 10(*b*) and FIG. 11(*a*), an electroconductive fluid containing chlorine ion in a concentration of 20 ppm was employed.

The cross-section 33 shown in FIG. 11(*a*) formed by the grinding wheel 31 which comprises a binding material consisting of pure aluminum has a smoother ground surface free from chips, with higher quality than those of the cross-section 33*a* and 33*b* which are respectively shown in FIG. 10(*a*) and FIG. 10(*b*), and were respectively formed by the grinding wheel which comprises a binding material consisting of a mixture of aluminum and nickel, and by the grinding wheel which comprises a binding material consisting of a mixture of aluminum and copper.

In the above-mentioned example of the present invention shown in FIG. 11(*a*), the concentration of chlorine ion contained in the electroconductive fluid was adjusted so as to be 20 ppm, whereby the degree of dressing of the grinding wheel 31 was appropriately adjusted, and accordingly the electrolytic in-process dressing degree of the grinding wheel 31 was also appropriately adjusted, and therefore the electrolytic elusion of the binding material from the grinding wheel 31 was appropriately adjusted and the formation of scratches and cracks in the grinding wheel 31 was prevented and stable grinding of the workpiece with higher quality and higher precision was attained.

With the concentration of chlorine ion contained in the electroconductive fluid changed from 0 ppm to 30 ppm, a groove was formed in a glass workpiece by use of the above-mentioned grinding wheel 31 comprising a binding material consisting of pure aluminum while the grinding wheel 31 was being subjected to the electrolytic in-process dressing.

FIG. 12(*a*) shows a groove 34*a* formed by the above-mentioned method by use of an electroconductive fluid with a chlorine ion concentration of 30 ppm.

FIG. 12(*b*) shows a groove 34*b* formed by the above-mentioned method by use of an electroconductive fluid with a chlorine ion concentration of 20 ppm.

FIG. 12(*c*) shows a groove 34*c* formed by the above-mentioned method by use of an electroconductive fluid with a chlorine ion concentration of 10 ppm.

FIG. 12(*d*) shows a groove 34*d* formed by the above-mentioned method by use of an electroconductive fluid with a chlorine ion concentration of 0 ppm.

As shown in FIGS. 12(*a*) through 12(*d*), when the chlorine ion concentration of the electroconductive fluid is increased, the amount of chips produced is decreased. This is because an elastic passive layer is formed deep into the surface layer beyond the contact surface 31*a* of the grinding wheel 31.

When the chlorine ion concentration exceeds 40 ppm, the elusion of the binding material of the grinding wheel 31 becomes excessive, so that the grains of the grinding wheel 31 are detached from the binding material and a large amount of chips is formed. Therefore, it is preferable that the chlorine ion concentration of the electroconductive fluid be in the range of 10 ppm to 40 ppm in order to obtain high quality ground surface.

With the chlorine ion concentration of the electroconductive fluid changed from 0 ppm to 30 ppm, a glass workpiece was cut by use of the above-mentioned grinding wheel 31 comprising a binding material consisting of pure aluminum while the grinding wheel 31 was being subjected to the electrolytic in-process dressing.

FIG. 13(*a*) shows a cross section 35*a* formed by the above-mentioned method by use of an electroconductive fluid with a chlorine ion concentration of 30 ppm.

FIG. 13(*b*) shows a cross section 35*b* formed by the above-mentioned method by use of an electroconductive fluid with a chlorine ion concentration of 20 ppm.

FIG. 13(*c*) shows a cross section 35*c* formed by the above-mentioned method by use of an electroconductive fluid with a chlorine ion concentration of 10 ppm.

FIG. 13(*d*) shows a cross section 35*d* formed by the above-mentioned method by use of an electroconductive fluid with a chlorine ion concentration of 0 ppm.

As shown in FIGS. 13(*a*) through 13(*d*), when the chlorine ion concentration of the electroconductive fluid is increased, the quality of the surface roughness of the formed cross section is improved. When the chlorine ion concentration exceeds 40 ppm, the quality of the surface roughness of the formed cross section is degraded. Therefore, it is preferable that the chlorine ion concentration of the electroconductive fluid be in the range of 10 ppm to 40 ppm in order to obtain high quality ground surface.

In the above-mentioned example, the binding material of the grinding wheel 31 consists of pure aluminum, but the binding material may consist of pure iron.

For the purposes of imparting rigidity to the grinding wheel 31, preventing the grinding wheel 31 from being destroyed or preventing a workpiece from being deformed, pure iron is better than pure aluminum as the material for the binding material.

When the binding material consists of a single metal component and a material with a resistivity of 1 MΩ.cm or more, no local-action-cells are formed either in the binding material during the in-process dressing, so that the binding material is not excessively eluted and accordingly chips, which may be otherwise formed by detaching of the grains from the grinding wheel 31, are rarely formed.

In the case where the binding material for the grinding wheel 31 consists of pure iron, and also in the case where the binding material consists of a single metal component and a material with a resistivity of 1 MΩ.cm or more, as to the electrolytic in-process dressing, the same effects as discussed with reference to FIGS. 6(*a*) through 9 were obtained. Japanese Patent Application No. 07-200155 filed Aug. 7, 1995 and Japanese Patent Application No. 08-93543 filed Mar. 22, 1996 are hereby incorporated by reference.

What is claimed is:

1. An electrically conductive grindstone, for grinding a workpiece which is capable of being electrolytically dressed during a grinding process of the workpiece, said grindstone comprising a surface layer which comprises abrasive grains and a binding material consisting of a single metal component, in which said abrasive grains are uniformly distributed and supported by said binding material, and can be subjected to dressing in the course of the grinding of said workpiece.

2. An electrically conductive grindstones, for grinding a workpiece, which is capable of being electrolytically dressed during a grinding process of the workpiece, said grindstone comprising a surface layer which comprises abrasive grains and a binding material consisting of a single metal component and a material with a resistivity of 1 MΩ.cm or more, in which said abrasive grains are uniformly distributed and supported by said binding material, and can be subjected to dressing in the course of the grinding of said workpiece.

* * * * *